United States Patent [19]

Taylor, Jr.

[11] Patent Number: 5,051,025

[45] Date of Patent: Sep. 24, 1991

[54] SLIP FORM PAVING MACHINE WITH OUTRIGGER WHEEL

[75] Inventor: Edward J. Taylor, Jr., Norco, Calif.

[73] Assignee: M-B-W Inc., Slinger, Wis.

[21] Appl. No.: 528,700

[22] Filed: May 24, 1990

[51] Int. Cl.[5] ..... E01C 11/22

[52] U.S. Cl. ..... 404/98; 404/102; 404/105; 404/118

[58] Field of Search ..... 404/105, 96, 98, 101, 404/102, 118; 249/1

[56] References Cited

U.S. PATENT DOCUMENTS

| | | | |
|---|---|---|---|
| 3,915,584 | 10/1975 | Coho, Jr. et al. | 404/98 |
| 3,920,349 | 11/1975 | Jennings, Jr. et al. | 404/98 |
| 3,969,035 | 7/1976 | Silbernagel | 404/98 |
| 4,789,266 | 12/1988 | Clarke, Jr. et al. | 404/105 |
| 4,900,186 | 2/1990 | Swisher, Jr. et al. | 404/105 |

FOREIGN PATENT DOCUMENTS

| | | | |
|---|---|---|---|
| 1534260 | 3/1969 | Fed. Rep. of Germany | 404/105 |

OTHER PUBLICATIONS

Gomaco Corporation, "GT-3300-A Versatile High Production Slipform Trimmer/Paver", 1987.

Curbmaster Incorporated, "Robot Slipform Paver".

Curbwalker Div. of Standard Industries Inc. "Curbmaster SM60".

Power Curbers Inc. "Slipform Pavers by Power Curbers".

*Primary Examiner*—Ramon S. Britts

*Assistant Examiner*—Roger J. Schoeppel

*Attorney, Agent, or Firm*—Andrus, Sceales, Starke & Sawall

[57] ABSTRACT

A slip form paving machine including a main frame supported by a front driven steering wheel and a pair of rear wheels that straddle the fore-and-aft center line of the main frame. An open top hopper is mounted on the frame and the lower end of the hopper communicates with an open bottom slip form, so that paving material, such as concrete fed into the hopper, will flow downwardly and be discharged from the slip form as the machine moves over the terrain. An outrigger frame is pivoted to the main frame about a horizontal axis and is located laterally of the rear wheels. The outrigger frame carries an outrigger wheel which is located laterally outwardly of the slip form and an inclined scraper blade is mounted forwardly of the outrigger wheel. When using a relatively wide slip form, the outrigger wheel is engaged with the terrain, and the rear wheel closest to the outrigger wheel is raised above the terrain so that the machine is supported on the outrigger wheel and the other of the rear wheels.

36 Claims, 4 Drawing Sheets

FIG. 4
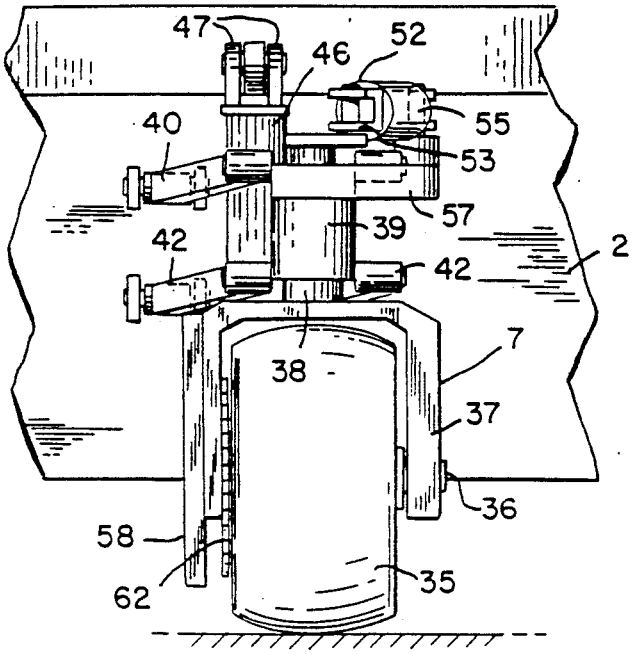
FIG. 5
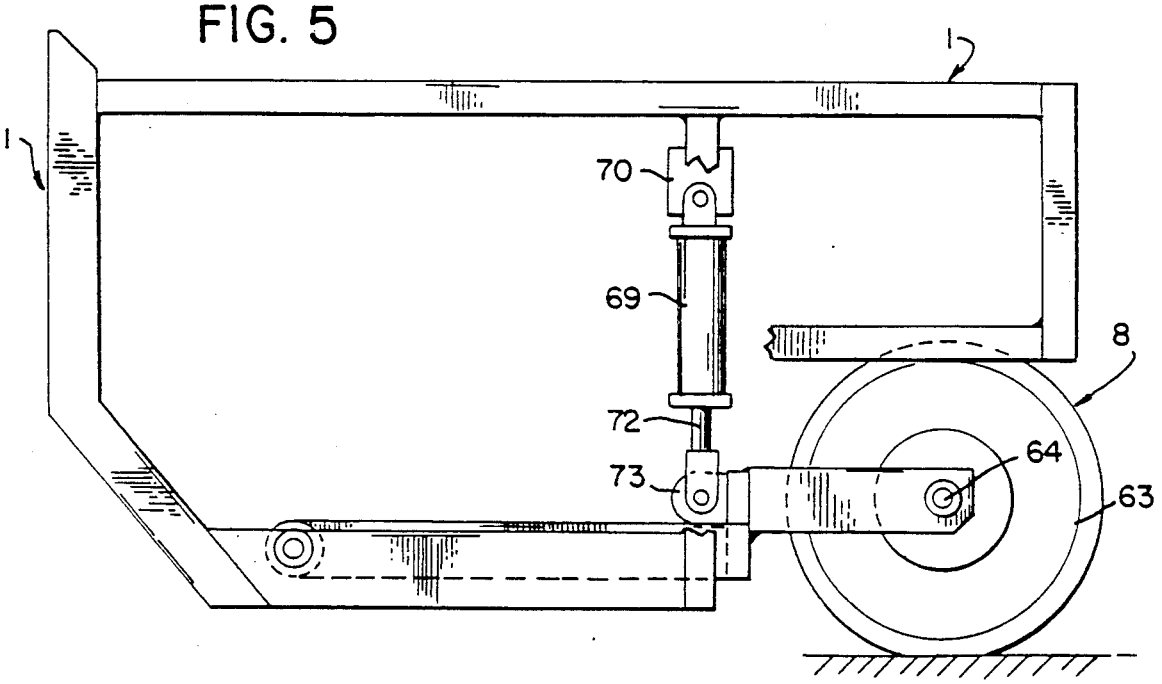
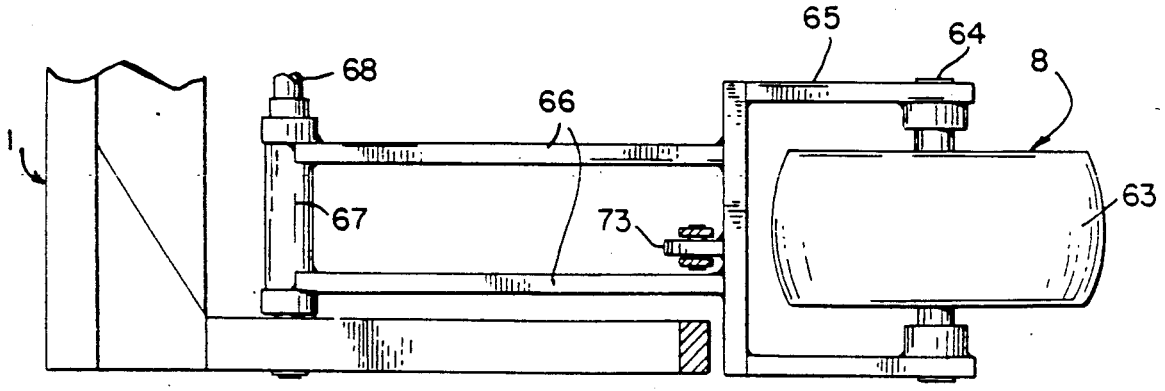
FIG. 6

SLIP FORM PAVING MACHINE WITH OUTRIGGER WHEEL

BACKGROUND OF THE INVENTION

Slip form pavers are used to pour concrete paver is a large self-propelled machine, including a frame supported by either rubber-tired wheels or endless treads. The frame includes an open top hopper to receive concrete which is fed downwardly for discharge through an open bottom slip form. In some machines, the wheels or treads will straddle the form, while in other machines the form and hopper are cantilevered laterally from the frame, thereby enabling the form to pass close to obstructions, such as walls, hydrants, posts, or the like.

The typical slip form paver is a large, heavy machine, having a weight generally in the range of about 6500 to 25,000 lbs. Due to the weight and size, the typical paver lacks maneuverability, and has a relatively large turning radius. As a consequence, the typical pavers cannot be effectively used when pouring short radius curbs and gutters, as in parking lots, driveways, or the like.

As a further disadvantage, due to its size and weight, the typical paver cannot be transported readily from site-to-site without disassembly. The disassembly and subsequent assembly at the new site substantially increases the set-up time for use of the machine.

Due to the weight the typical paver cannot ride on freshly poured asphalt without marring or deforming the surface.

Because of its large size, the conventional paver has restricted visibility and normally requires a three-man crew for operation, including a driver, a chute man and a sensor man.

SUMMARY OF THE INVENTION

The invention is directed to a compact, self-propelled, slip form paving machine which, because of its compact size is more maneuverable than conventional pavers and can be readily moved or transported without disassembly.

The paver of the invention includes a main frame which is supported by a front driven steering wheel and a pair of rear wheels which are spaced laterally of the fore-and-aft center line of the machine. An open-top hopper is mounted on the frame and the lower end of the hopper communicates with an open bottom slip form. Concrete, or other paving material, fed into the hopper will flow by gravity with the aid of vibrators into the form and will be discharged or poured in the desired shape of the curb and/or gutter as the machine is propelled over the terrain.

When pouring gutters or walkways having a substantial width, the off-center weight of the concrete in the hopper is supported by an outrigger assembly that is pivotally connected to the main frame about a horizontal axis. The outrigger assembly includes an outrigger wheel that is located laterally of the rear wheels of the machine, and is positioned laterally outward of the hopper and slip form.

A scraper blade can be mounted on the outrigger frame forwardly of the outrigger wheel and acts to scrape and smooth the ground surface ahead of the travel of the outrigger wheel.

The front steering wheel, the rear wheels and the outrigger wheels can all be independently raised and lowered to position the form at the desired level relative to the ground surface and to compensate for unevenness of the ground surface. In addition, the scraper blade can be raised and lowered independently with respect to the outrigger frame to control the height of the scraper blade relative to the outrigger wheel.

With the outrigger in place, the rear wheel located adjacent the outrigger wheel is raised and locked in an elevated position, so that the machine will then be supported on the front steering wheel, the outrigger wheel and the other rear wheel. Because of the light weight of the machine, the outrigger wheel provides stability, enabling the machine to pour relatively wide curb and gutter shapes.

To propel the machine over the ground, the front steering wheel is driven and as the front steering wheel is offset from the center line of the machine, when the outrigger is assembled, the outrigger wheel is also driven to prevent yawing.

As a feature of the invention, the hopper is provided with sloping or inclined side walls, so that a portion of the weight of the concrete is transferred through the hopper walls and is carried by the wheels. As the machine is light in weight, the machine may tend to float on the concrete and the sloping walls of the hopper counteract this tendency by transmitting a portion of the weight of the concrete to the machine itself.

The invention provides a compact machine having a weight generally in the neighborhood of about 1500 lbs. Because of its compact size, the machine is more maneuverable than conventional slip form pavers and has a relatively short turning radius in the neighborhood of about 2.5 feet. Due to its light weight, the machine can ride on fresh asphalt surfaces without deforming or marring the surface.

The compact size of the machine enables the machine to be readily transported without disassembly and this substantially reduces the set-up time for use of the machine.

The paver of the invention, due to its compact size, has better visibility and is adapted for single man operation.

As a further advantage, the hopper is designed so that concrete can be fed to the hopper through a full 360° arc.

Through use of the outrigger, the machine is capable of pouring various curb and gutter configurations of up to about 36 inches in width and 20 inches in height.

Other objects and advantages will appear in the course of the following description.

DESCRIPTION OF THE DRAWINGS

The drawings illustrate the best mode presently contemplated of carrying out the invention.

In the drawings:

FIG. 4 is a front end view of the construction shown in FIG. 3;

FIG. 5 is a fragmentary enlarged vertical section showing the mechanism for raising and lowering one of the rear wheels;

FIG. 6 is a fragmentary enlarged horizontal section showing the mechanism for raising and lowering one of the rear wheels;

DESCRIPTION OF THE ILLUSTRATED EMBODIMENT

Figure 1:
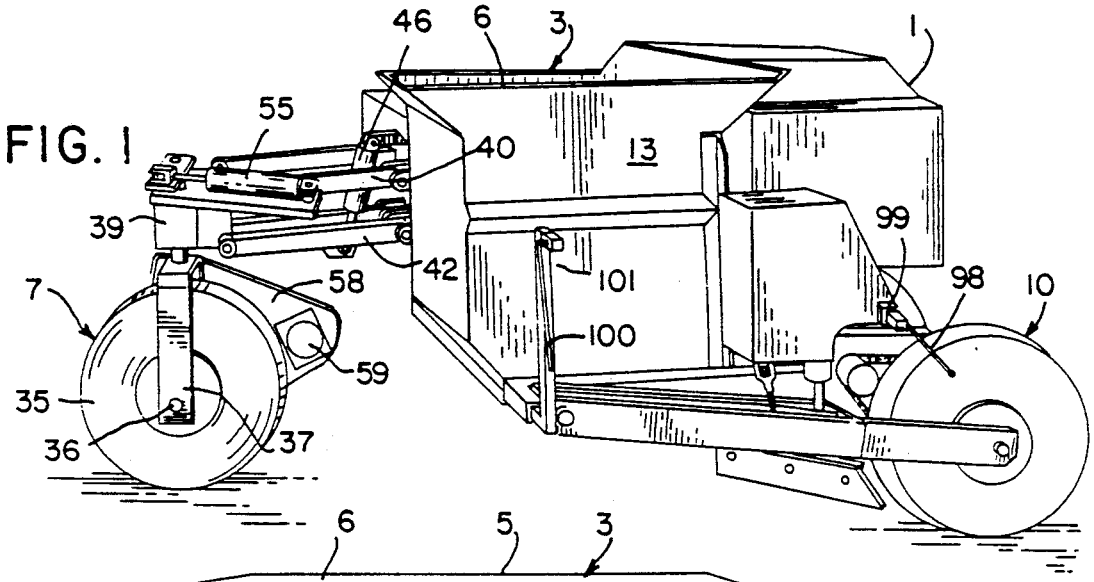
FIG. 1 is a perspective view of the side of the paving machine of the invention.
Figure 2:
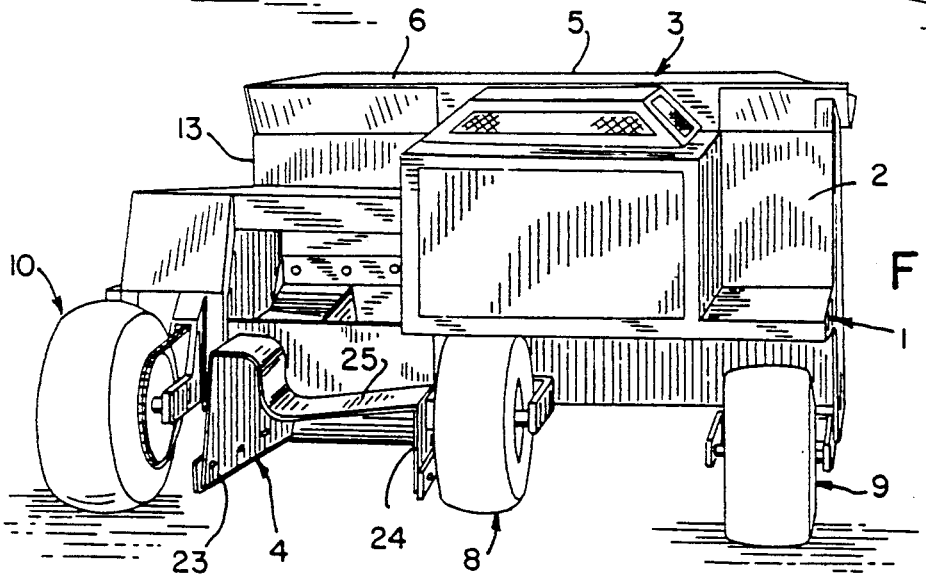
FIG. 2 is a perspective view of the rear of the machine.

The drawings illustrate a lightweight, compact, self-propelled slip form paving machine which is composed of a main frame or supporting structure 1, and a body 2 is mounted on frame 1 and defines an open-top hopper 3, into which a paving material, such as concrete, is fed. The lower end of the hopper 3 communicates with the forward end of an open bottom slip form 4. The concrete in hopper 3 will flow downwardly into form 4 and will be discharged from the form in the shape of a curb and gutter, as illustrated in FIG. 2, as the machine moves over the ground or terrain.

Hopper 3 is composed of a main hopper section 5 which is integral with body 2 and a side section 6 that is removable from section 5.

The machine is supported from the ground by a forward steering wheel assembly 7 and a pair of rear wheel assemblies 8 and 9. In addition, an outrigger wheel assembly 10 is pivoted to the side hopper section 6 and is located laterally outward of the slip form 4, as illustrated in FIG. 2.

Figure 9:
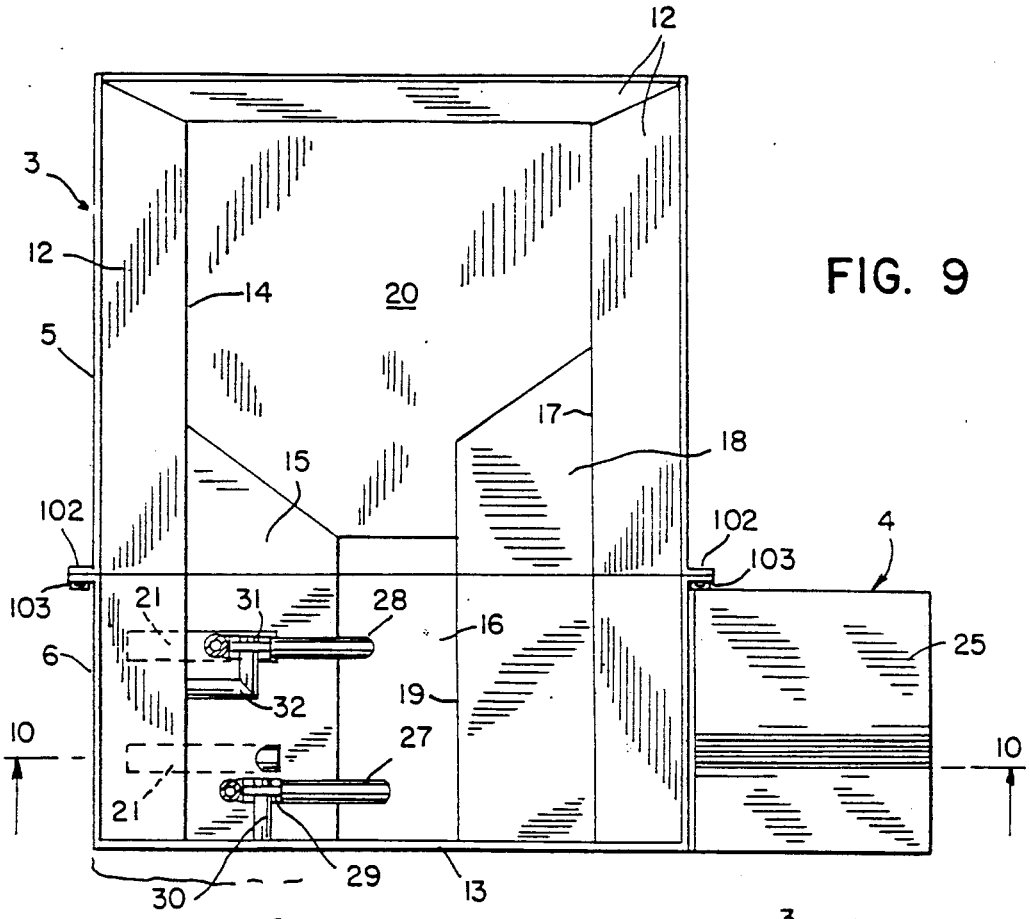
FIG. 9 is a top view of the body of the machine showing the hopper.
Figure 10:
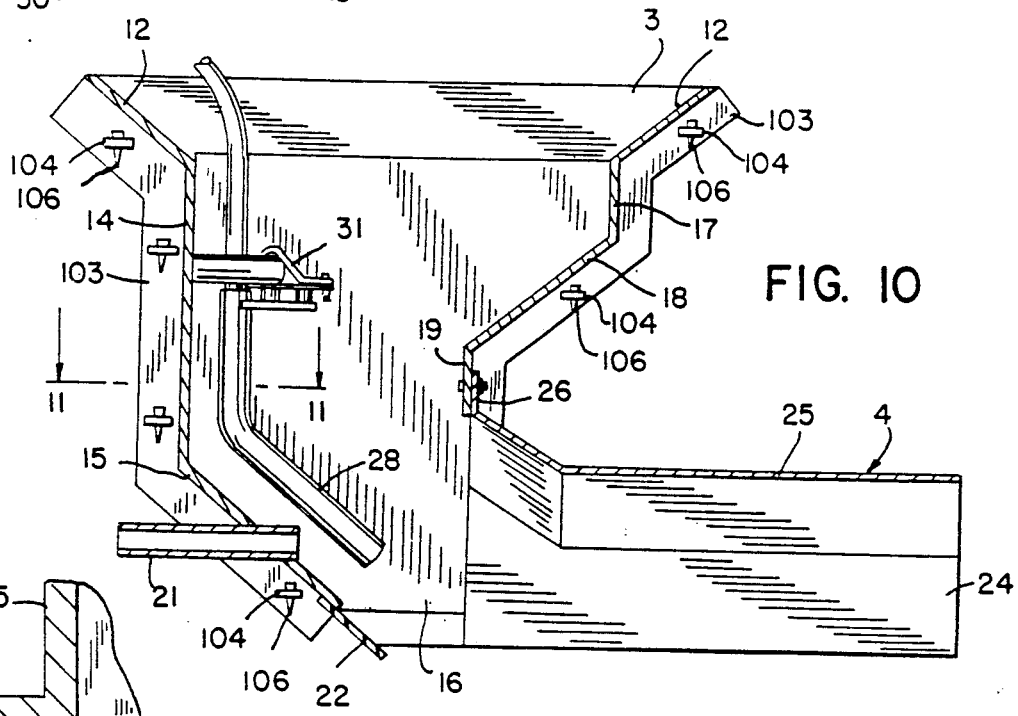
FIG. 10 is a vertical section taken along line 10—10 of FIG. 9.

As illustrated in FIGS. 9 and 10, the upper rim of hopper 3 at the front, rear and right side is provided with an inclined surface as indicated by 12. The opposite or left side of the hopper, adjacent the outrigger, has a vertical side wall 13.

Hopper 3 also includes a vertical front wall 14 which extends downwardly from the inclined surface 12 and the lower end of vertical wall 14 merges into an inclined wall 15, which terminates at an opening 16.

Hopper 3 also includes a vertical rear wall 17 which extends downwardly from inclined surface 12, and the lower end of wall 17 is connected to inclined wall 18, which in turn, merges with vertical wall 19, as shown in FIG. 10.

The lower end of hopper section 5 is enclosed by a bottom surface 20 that slopes toward opening 16.

In order to reinforce the curb or gutter being poured, one or more tubes 21 extend through wall 15 and communicate with the lower end of hopper section 6. Reinforcing rods can be fed through tubes 21 and as the machines moves over the ground surface, the rods will be embedded in the poured concrete.

A resilient flap 22, composed of rubber or similar material, projects downwardly from the lower edge of inclined wall 15 and is adapted to ride on the ground surface.

Hopper section 6 is integrally connected with the outrigger wheel assembly 10 and the slip form 4. Thus, by disconnecting the hopper section 6 from section 5, the hopper section 6, as well as the outrigger wheel assembly and slip form, can be removed from the machine.

The slip form 4, as seen in FIG. 2, is adapted to pour a curb and gutter, and includes a pair of spaced generally vertical side walls 23 and 24, which are connected by a top wall 25. As shown in FIG. 10, the forward edge of top wall 25 is provided with an upstanding flange 26, which is attached to the wall 19 of the hopper.

To facilitate movement of the concrete through the hopper 3 and into the form 4, a pair of conventional vibrating units 27 and 28 are mounted within the upper end of the hopper. The upper end of vibrating unit 27 is connected by a clamp 29 to bracket 30 projecting inwardly from end wall 13, and similarly vibrating unit 28 is attached via clamp 31 to an L-shaped bracket 32 extending inwardly from wall 14 of the hopper. Vibrating units 27 and 28 are dog-leg shaped and the lower end of each unit is located adjacent the inlet to the slip form 4, as seen in FIG. 10.

The forward steering wheel assembly 7 includes a rubber-tired wheel 35, carried by axle 36, which is mounted for rotation on fork 37. Shaft 38 extends upwardly from fork 37 and is mounted for rotation within a spindle housing 39. Two pair of swing arms 40 and 42 interconnect the housing 39 with main frame 1, and permit the wheel 35 to be raised and lowered relative to the frame.

Figure 3:
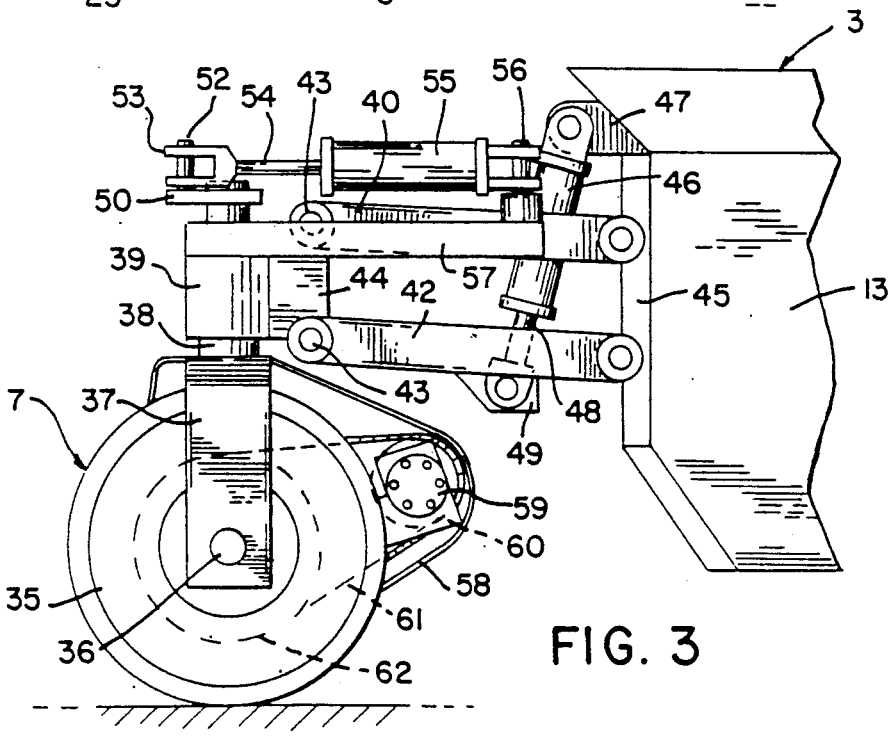
FIG. 3 is an enlarged fragmentary side elevation showing the front steering wheel.

As shown in FIGS. 3 and 4, the forward ends of upper arms 40 are pivotally connected to horizontal shafts 43 that are secured to plate 44, which extends rearwardly from housing 39, while the rear ends of arms 40 and 42 are pivotally connected to flanges 45 that extend outwardly from body 3.

To raise and lower wheel 35, one end of a cylinder 46 is pivotally connected to lugs 47 that extend forwardly from body 3. A piston rod 48 is mounted for sliding movement within the cylinder and the lower end of the piston rod is pivotally connected to a bar 49 which is connected to the lower surfaces of arms 42.

Through operation of cylinder 46, the piston rod 48 can be extended and retracted to pivot arms 40 and 42 and thereby raise and lower wheel 35 relative to frame 1 and body 2.

In order to steer the machine, the wheel 35 is pivoted about the axis of shaft 38. To provide this pivoting movement, a plate 50 extends outwardly from the upper end of shaft 38 and an upstanding pin 52 is mounted on the plate and is offset from the axis of shaft 38. The bifurcated end 53 of a piston rod 54 is pivotally connected to pin 52. Piston rod 54 is slidable relative to cylinder 55, and the opposite end of the cylinder is pivotally connected to an upstanding pin 56, which is mounted on the rear end of arm 57 secured to housing 39. With this construction, operation of cylinder 55 will operate to rotate shaft 38 and thereby turn wheel 35 to provide steering for the machine.

The machine is self-propelled and to propel the machine the wheel 35 is driven. In this regard, a flanged plate 58 is secured to one of the legs of fork 37 and extends rearwardly from the fork. A hydraulic motor 59 is mounted through a suitable bracket to plate 58 and the output shaft of motor 59 carries sprocket 60 that is connected through a chain drive 61 to sprocket 62 on axle 36. Thus, operation of motor 59 will rotate the wheel 35 to propel the machine over the terrain.

The rear wheel assemblies 8 and 9 are basically of the same construction and only the left or port side wheel assembly 8 is shown in detail in the drawings. As illustrated in FIGS. 5 and 6, the wheel assembly 8 includes a rubber tired wheel 63 which is mounted on a horizontal axle 64. The axle is journaled through suitable bearings within a fork 65 and the fork is connected through a pair of parallel arms 66 to a sleeve 67 that is mounted for rotation about shaft 68 that is connected to frame I. With this construction, the arms 66 along with wheels 63 can be pivoted about the axis of shaft 68 to thereby raise and lower wheel 63 relative to frame 1.

Wheel 63 is raised and lowered by a hydraulic cylinder unit. As best shown in FIG. 5, one end of a cylinder 69 is pivotally connected to a bracket 70 that is attached to frame 1. A piston rod 72, which is slidable with respect to cylinder 69, is pivotally connected to a lug 73 that extends forwardly from fork 65. Through operation of cylinder 69, the arms 66 can be pivoted about the axis of shaft 68 to thereby raise and lower wheel 63 relative to the frame. Wheel 63 can be locked in the upper position by suitable valving in the hydraulic system. As previously noted, a similar construction is employed to raise and lower the wheel of rear wheel assembly 9.

Figure 7:
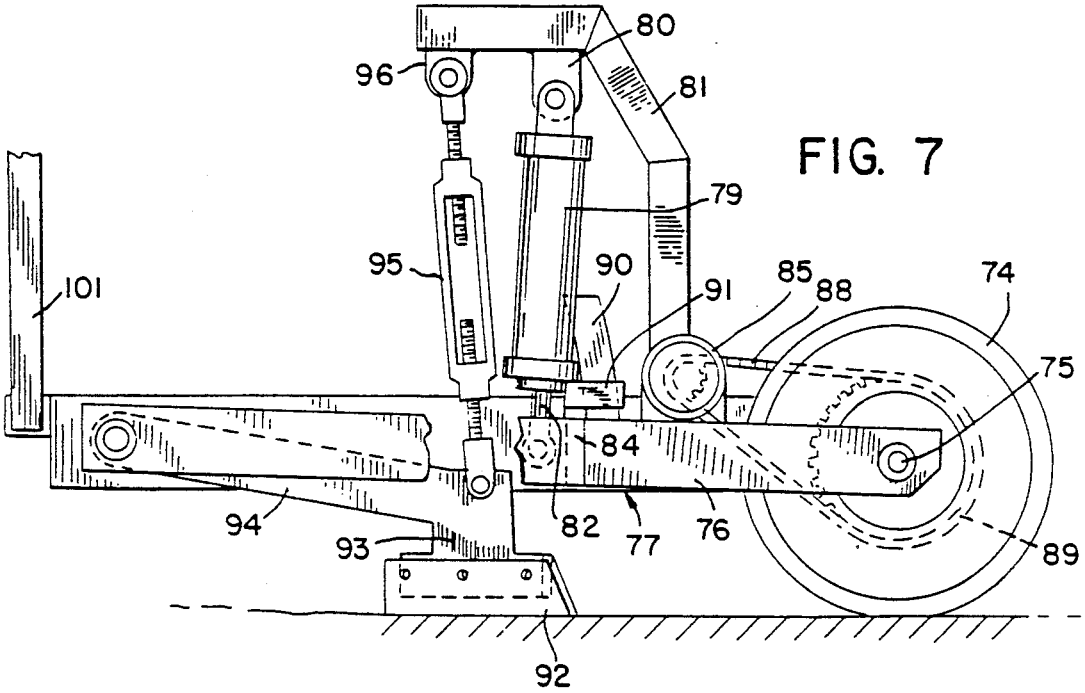
FIG. 7 is a fragmentary enlarged side elevation of the outrigger.
Figure 8:
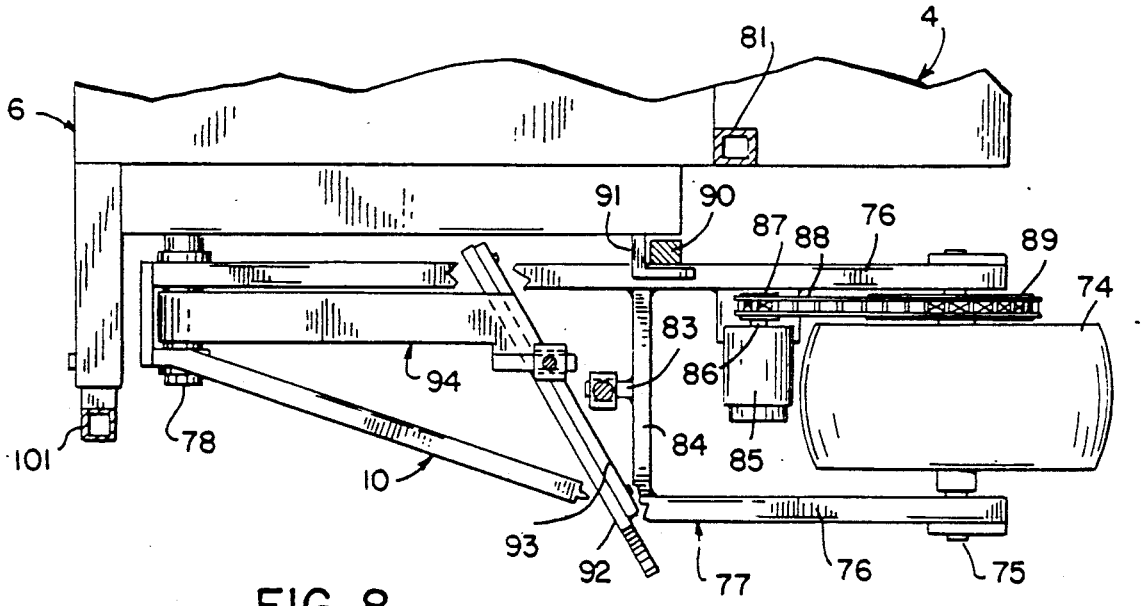
FIG. 8 is a top plan view of the construction shown in FIG. 7.

The outrigger wheel assembly 10 is best illustrated in FIGS. 7 and 8. The assembly 10 includes a rubber-tired wheel 74 that is mounted on a horizontal axle 75, and the axle is journaled within a pair of parallel arms 76 of outrigger frame 77. Axle 75 of the outrigger wheel is in alignment with the axles 64 of the rear wheel assemblies 8 and 9 and is generally aligned with the rear end of the slip form 4.

The forward end of outrigger frame 77 is mounted for pivotal movement about horizontal stub shaft 78, which extends outwardly from hopper section 6.

To pivot frame 77 about shaft 78, and thereby raise and lower wheel 74, the upper end of a hydraulic cylinder 79 is pivotally connected to lugs 80 on support bracket 81 that extends upwardly and laterally outward from slip form 4. A piston rod 82 is slidable relative to cylinder 79 and the outer end of the piston rod is pivotally connected to a lug 83 which extends forwardly from cross member 84 of frame 77. Thus, operation of cylinder 79 will pivot frame 77 about shaft 78 and thereby raise and lower the outrigger wheel 74.

With the outrigger attached, the steering wheel 35 is not located on the fore and aft center line of the machine, and accordingly, the machine may tend to yaw as it is moves over the ground. To prevent yawing, the outrigger wheel 74 is also driven and the drive includes a hydraulic motor 85 which is mounted through a suitable bracket to one of the arms 76 of frame 77. The output shaft 86 of motor 85 carries a sprocket 87 which is connected via chain 88 to a sprocket 89 mounted on axle 75. Operation of motor 85 will thus drive wheel 74 to prevent yawing of the machine.

To guide outrigger frame 77 in vertical pivoting movement, a guide bar 90 is attached to the inner arm 76 of the frame and rides between the outer surface of hopper section 6 and an L-shaped guide 91, as shown in FIGS. 7 and 8.

As a feature of the invention, a scraper or blade 92 is mounted ahead of the outrigger wheel 74 to scrape and smooth the ground ahead of the wheel. As shown in FIGS. 7 and 8, the scraper blade 92 is disposed in a vertical orientation and is at an angle to the direction of travel of the machine. The upper edge of the blade 92 is connected by bolts to a bracket 93 that is mounted on the rear end of a scraper frame 94. The forward end of the scraper frame is mounted for vertical pivotal movement on the shaft 78.

The scraper blade is adapted to be raised and lowered independently of the outrigger frame 77. In this regard, one end of a turnbuckle 95 is pivotally connected to lugs 96 on support bracket 81, while the lower end of the turnbuckle is pivotally connected to bracket 93. Through operation of the turnbuckle 95, the blade 92 can be raised and lowered relative to outrigger frame 77 and wheel 74. As the machine moves over the ground, the blade 92 will smooth the ground surface ahead of the outrigger wheel 74 to aid in maintaining uniformity of the poured concrete.

The steering of the machine, as well as the vertical height of the form 4 relative to the ground, can be automatically controlled by a sensing mechanism in a conventional manner. A sensor 98 extends horizontally from a bracket 99 mounted on the rear end of outrigger frame 77, and the sensor 98 is adapted to ride along a horizontal guide wire, not shown, to sense the horizontal orientation of the machine. The sensor 98 is operably connected to the lift cylinders 46, 69 and 79 and will actuate the cylinders as the ground level varies to maintain the machine and slip form 4 at the desired horizontal level.

A second vertical sensor 100 is mounted through upstanding post 101 to the hopper section 6 and sensor 100 is adapted to ride along the guide wire to maintain directional control of the machine. Sensor 100 is operably connected to the directional cylinder 58 of the steering wheel assembly 7 and will act to operate the cylinder to maintain the machine in the proper directional path in a conventional manner.

The paving machine of the invention is of light weight and the outrigger wheel assembly 10 provides stability to enable the machine to pour wide curb and gutter shapes up to about 36 inches in width. If a curb alone, without a gutter, is being poured, the machine can be used without the outrigger wheel assembly 10 and the side hopper section 6. In this case, the side of the hopper section 5 is enclosed by a side plate, which carries the curb form. As the curb form would extend only several inches laterally of the rear wheel assembly 8, the outrigger wheel assembly 10 would not be required for stability.

It is also contemplated that the machine can be employed to pour wider shapes for bike pathways, walkways, and the like. In this case, a wider hopper section 6 extending outwardly for several feet can be substituted, along with an outrigger wheel assembly 10, for stability.

Figure 11:
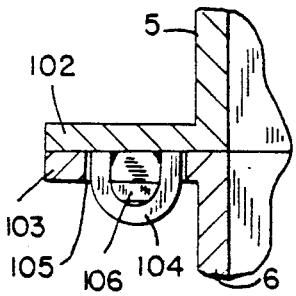
FIG. 11 is a section taken along line 11—11 of FIG. 10 and showing the releasable connection between the hopper sections.

The manner of connection of side hopper section 6 to hopper section 5 is best illustrated in FIGS. 9–11. The front and rear ends of hopper sections 5 and 6 are provided with mating outwardly extending flanges 102 and 103, respectively. A series of loops 104 are secured to flanges 102 and are received in slots 105 formed in the opposed flanges 103 and wedges 106 are driven into the ends of the loops 104 to wedge the flanges together By removing the wedges 106, the hopper section 6 can be conveniently and quickly removed from hopper section 5.

The sloping side walls of the hopper 3 are an important feature of the invention, in that a portion of the weight of the concrete within the hopper is transferred through the sloping walls and is carried by the wheels. As the machine is relatively light in weight and as the concrete has substantial weight, there would be a tendency for the machine to float on the concrete as it is being poured. The sloping walls of the hopper counteract this tendency by enabling a portion of the concrete to be carried by the machine itself, thus preventing floating.

Due to the compact size of the machine, the machine is more maneuverable than conventional types and has a short turning radius in the range of about 2.5 feet, thus enabling the machine to be used for forming curbs and gutters in parking lots and the like which are apt to have a number of short radius curves.

The machine can be operated by a single workman, thereby reducing the labor cost of the paving operation, as opposed to larger paving machines which require a three-man crew.

Various modes of carrying out the invention are contemplated as being within the scope of the following claims particularly pointing out and distinctly claiming the subject matter which is regarded as the invention.

I claim:

1. A slip form paving machine, comprising a main frame, front wheel means connected to the frame and mounted for movement about a vertical axis, means for pivoting said front wheel means about said axis to steer the machine, first rear wheel means mounted on the frame, second rear wheel means mounted on the frame and spaced laterally from said first rear wheel means, outrigger wheel means pivoted to the frame about a horizontal axis and spaced on the opposite side of said second rear wheel means from said first rear wheel means, a hopper on the frame to receive a paving material, a slip form carried by the frame and communicating with said hopper for discharging said material onto the ground in a desired configuration, and means for raising said second wheel means out of contact with the ground whereby the machine during paving is supported by said front wheel means, said first rear wheel means and said outrigger wheel means.

2. The machine of claim 1, and including first drive means for driving said front wheel means, and second drive means for driving said outrigger wheel means.

3. The machine of claim 1, wherein said outrigger wheel means comprises an outrigger frame pivoted to said main frame about said horizontal axis and an outrigger wheel journaled on said outrigger frame.

4. The machine of claim 3, wherein said outrigger wheel is journaled about a horizontal axle, said axle being generally aligned with the rear end of said slip form.

5. The machine of claim 2, wherein said outrigger wheel means comprises an outrigger frame and an outrigger wheel journalled on the outrigger frame and said second drive means is carried by the outrigger frame and is operably connected to said outrigger wheel.

6. The machine of claim 5, wherein said second drive means comprises a hydraulic motor.

7. The machine of claim 3, and including blade means located forwardly of said outrigger wheel and disposed to smooth the ground surface ahead of said outrigger wheel.

8. The machine of claim 7, wherein said blade means comprises a scraper blade frame and a scraper blade mounted on the scraper frame and disposed at an angle to the direction of fore and aft travel of said machine.

9. The machine of claim 8, wherein said scraper frame is mounted for pivotal movement relative to said supporting structure about a horizontal pivot axis.

10. The machine of claim 9, and including means for pivoting said scraper frame about the horizontal pivot axis to raise and lower said scraper blade relative to said outrigger wheel.

11. The machine of claim 9, wherein said horizontal axis and said horizontal pivot axis are the same axis.

12. The machine of claim 3, and including guide means for guiding said outrigger frame in vertical pivotal movement.

13. The machine of claim 12, wherein said guide means comprises a first guide member strip on the main frame.

14. A slip form paving machine, comprising a main frame, front wheel means mounted on said main frame, rear wheel means mounted on said main frame, outrigger wheel means pivoted to said main frame about a horizontal axis and spaced laterally from said rear wheel means, hopper means on said main frame for receiving a paving material, a slip form carried by the main frame and communicating with said hopper means, said material flowing from said hopper means and being discharged from said slip form on the ground surface in a desired shape, said outrigger wheel means being located laterally outward of said hopper means and said slip form, said outrigger wheel means comprising an outrigger frame pivoted to said main frame about said horizontal axis and an outrigger wheel journaled on said outrigger frame, and first lifting means for pivoting said outrigger frame about said horizontal axis to raise and lower said outrigger wheel relative to said main frame.

15. The machine of claim 14, wherein said rear wheel means comprises a pair of spaced rear wheels aligned with said outrigger wheel, and means for independently raising and lowering each of said rear wheels relative to said main frame.

16. The machine of claim 14, and including scraper blade means located forwardly of said outrigger wheel, and means for raising and lowering said scraper blade means relative to said outrigger wheel.

17. The machine of claim 16, wherein said scraper blade means comprises a scraper blade disposed at an angle to the fore and aft direction of travel of said machine.

18. The machine of claim 17, wherein said scraper blade means also includes a scraper frame pivotally connected to the main frame about a horizontal axis, said scraper blade being connected to said scraper blade frame.

19. The machine of claim 14, wherein said rear wheels and said outrigger wheel comprise rubber-tired wheels.

20. A slip form paving machine, comprising a supporting structure, front wheel means mounted on said supporting structure for movement about a vertical axis to steer said machine, means for pivoting said front wheel means about said vertical axis, first rear wheel means mounted on the supporting structure, second rear wheel means mounted on the supporting structure and spaced laterally from said first rear wheel means, an outrigger wheel assembly attached to a side of said supporting structure and including an outrigger frame pivoted to the supporting structure about a horizontal axis, said assembly also including an outrigger wheel mounted on said outrigger frame and spaced from said horizontal axis, said outrigger wheel disposed on the opposite side of said second rear wheel means from said first rear wheel means, hopper means mounted on the supporting structure for receiving a paving material, a slip form carried by the supporting structure and communicating with said hopper means, said material flowing from said hopper means and into said slip form and being discharged from said slip form in a desired contour, and means for raising said second wheel means out of contact with the ground surface whereby said machine is supported by said front wheel means, said first rear wheel means and said outrigger wheel, said outrigger wheel being disposed laterally outward of said slip form.

21. The machine of claim 20, wherein said hopper means is disposed forwardly of said slip form and extends laterally outward from a fore-and-aft vertical plane extending through said second rear wheel means.

22. The machine of claim 20, and including locking means for locking said second rear wheel means in an upper position out of contact with said ground.

23. The machine of claim 20, and including first drive means for driving said forward front wheel means, and second drive means for driving said outrigger wheel.

24. The machine of claim 23, and including means for raising and lowering said front wheel means and said first rear wheel means relative to said supporting structure.

25. A slip form paving machine, comprising a supporting structure, wheel means for supporting said structure from the ground, hopper means on said supporting structure to receive a quantity of a paving material, slip form means carried by the supporting structure and communicating with said hopper means for receiving said material from said hopper means and discharging the material on said ground in a desired configuration, outrigger wheel means disposed laterally outward of said slip form means and disposed to support the machine from the ground, and sensing means mounted on said outrigger wheel means and disposed to engage a guide member for maintaining said machine in a given path of travel.

26. The machine of claim 25, wherein said sensing means comprises a sensing member disposed to engage a horizontal guide member, said machine including first lift means for raising and lowering said front wheel means, second lift means for raising and lowering said rear wheel means, and third lift means for raising and lowering said outrigger wheel means, said sensing member being operably connected to said first, second and third lift means to maintain said machine in the desired horizontal orientation.

27. A slip form paving machine, comprising a supporting structure, wheel means for supporting said structure from the ground, hopper means on said supporting structure to receive a quantity of a paving material, said hopper means comprising a main hopper section and a removable side section, slip form means connect to said side section and communicating with said hopper means for receiving said paving material from said hopper means and discharging said material in a desired configuration on a surface, and outrigger wheel means for supporting said structure from the ground and connected to said side section, said slip form means being located between said wheel means and said outrigger wheel means.

28. The machine of claim 27, wherein said outrigger wheel means comprises an outrigger frame and an outrigger wheel mounted on said outrigger frame, said wheel means comprises a pair of rear wheels aligned with said outrigger wheel.

29. The machine of claim 28, wherein the axis of said outrigger wheel is aligned with the rear end of said slip form means.

30. The machine of claim 28, and including means for raising and lowering a first of said rear wheels located adjacent said outrigger wheel, so that said machine is supported on, the other of said rear wheels and said outrigger wheel.

31. The machine of claim 27, wherein said hopper means includes an inclined wall, a portion of the weight of said material being transmitted through said inclined wall to said wheel means. .

32. The machine of claim 31, and including vibratory means disposed in said hopper means for vibrating said material.

33. The machine of claim 32, wherein said hopper means has an opening communicating with the forward end of said slip form means, said vibratory means being disposed adjacent said opening.

34. The machine of claim 27, wherein said side section, said slip form means, and said outrigger wheel means comprise an integral unit removable from said supporting structure.

35. The machine of claim 27, and including removable connecting means for connecting said side section to said main section.

36. The machine of claim 35, wherein said removable connecting means comprises mating flanges on said sections, an aperture in one of said flanges, a loop on the other of said flanges and projecting through said aperture, and wedge means disposed in the projecting end of said loop for wedging said flange together.

* * * * *

UNITED STATES PATENT AND TRADEMARK OFFICE
CERTIFICATE OF CORRECTION

PATENT NO. : 5,051,025

DATED : September 24, 1991

INVENTOR(S) : EDGAR J. TAYLOR, JR.

It is certified that error appears in the above-identified patent and that said Letters Patent is hereby corrected as shown below:

ON THE TITLE PAGE

At [75] Delete "Edward" and substitute therefor --Edgar";

Col. 1, Line 6, After "concrete" insert -- curb, gutters and narrow walkways. The typical slip form--.

Col. 5, Line 3, Delete "1" and substitute therefor --I--

Col. 10, Line 22, CLAIM 30, After "on" delete ","

Signed and Sealed this

Twentieth Day of July, 1993

*Attest:*

*Attesting Officer*

Michael K. Kirk

MICHAEL K. KIRK

*Acting Commissioner of Patents and Trademarks*